US006128881A

United States Patent [19]

Bue et al.

[11] Patent Number: 6,128,881

[45] Date of Patent: Oct. 10, 2000

[54] PORTABLE FLOOR

[75] Inventors: Richard C. Bue, Chaska; Harry V. Levey, Bloomington, both of Minn.

[73] Assignee: Sico Incorporated, Edina, Minn.

[21] Appl. No.: 09/177,156

[22] Filed: Oct. 22, 1998

[51] Int. Cl.[7] ..... E04F 15/00

[52] U.S. Cl. ..... 52/582.2; 52/177; 52/591.1; 52/592.1; 52/656.9

[58] Field of Search ..... 52/177, 591.1, 52/589.1, 592.1, 656.1, 656.9, 582.2, 582.1, 391

[56] References Cited

U.S. PATENT DOCUMENTS

| | | | |
|---|---|---|---|
| 369,478 | 9/1887 | Snow . | |
| 876,912 | 1/1908 | Pike . | |
| 1,175,316 | 3/1916 | Solon . | |
| 1,894,584 | 1/1933 | Fort | 52/391 |
| 2,021,922 | 11/1935 | Peck . | |
| 2,115,936 | 5/1938 | Sterns . | |
| 2,142,305 | 1/1939 | Davis . | |
| 2,217,781 | 10/1940 | Wiley . | |
| 2,377,211 | 5/1945 | Cocken, Jr. . | |
| 2,490,577 | 12/1949 | Brown | 52/591.1 |
| 2,666,508 | 1/1954 | Nardulli | 52/656.9 |
| 2,822,585 | 2/1958 | Baruch . | |
| 3,141,392 | 7/1964 | Schneider et al. . | |
| 3,191,726 | 6/1965 | Pavlecka . | |
| 3,239,986 | 3/1966 | Russell . | |
| 3,248,995 | 5/1966 | Meyer . | |
| 3,310,919 | 3/1967 | Bue et al. . | |
| 3,385,183 | 5/1968 | Kortz . | |
| 3,400,958 | 9/1968 | Haimes et al. . | |
| 3,500,606 | 3/1970 | Wharmby . | |
| 3,567,260 | 3/1971 | Norris . | |
| 3,599,385 | 8/1971 | LaRue . | |
| 3,826,056 | 7/1974 | Smith et al. . | |
| 3,890,753 | 6/1975 | Johansen . | |
| 4,045,927 | 9/1977 | Diaz . | |
| 4,057,948 | 11/1977 | Wise . | |
| 4,144,681 | 3/1979 | Leffler et al. . | |
| 4,205,470 | 6/1980 | Kapnek | 52/656.1 X |
| 4,411,118 | 10/1983 | Claver | 52/582.2 |

(List continued on next page.)

FOREIGN PATENT DOCUMENTS

| | | |
|---|---|---|
| 486349 | 8/1977 | Australia . |
| 0 117 707 | 9/1984 | European Pat. Off. . |
| 0 171 324 | 2/1986 | European Pat. Off. . |
| 0 857 839 A2 | 8/1998 | European Pat. Off. . |
| 1 347 862 | 11/1963 | France . |
| 89184 | 5/1967 | France . |
| 2 445 461 | 12/1978 | France . |
| 2 145 024 | 3/1973 | Germany . |
| 2 248 892 | 4/1974 | Germany . |
| 24 48 880 | 4/1976 | Germany . |
| 512 697 | 9/1971 | Switzerland . |
| 97/21011 | 6/1997 | WIPO . |

OTHER PUBLICATIONS

"Sico® The Original Portable Dance Floor", Sico Incorporated, ©1990 (brochure and price list, 6 pgs).

*Primary Examiner*—Beth A. Stephan
*Assistant Examiner*—Brian E. Glessner
*Attorney, Agent, or Firm*—Merchant & Gould P.C.

[57] ABSTRACT

A portable floor system includes a plurality of substantially rectangular floor panels adapted for connection along their edges to form an extended floor surface. The extruded edges include complementary tongues and grooves, and complementary locking members for aligning and connecting the edges of the panels. The tongues include notches and the grooves have complementary vertical pins to aid in aligning the panels during locking. The portable floor system has transitional edge trim panels that provide a transition from the floor surface to the underlying supporting surface. The edge trim panels include ribs forming slots for receiving alignment members that provide alignment between the ends of the edge trim panels. The alignment members include set screws and L-shaped members for inserting into complementary ends of corner edge trim panels.

12 Claims, 6 Drawing Sheets

U.S. PATENT DOCUMENTS

| | | | |
|---|---|---|---|
| 4,465,398 | 8/1984 | Knudsen . | |
| 4,468,910 | 9/1984 | Morrison . | |
| 4,538,392 | 9/1985 | Hamar et al. . | |
| 4,893,449 | 1/1990 | Kemper | 52/391 X |
| 4,988,131 | 1/1991 | Wilson et al. . | |
| 5,022,200 | 6/1991 | Wilson et al. | 52/582.2 X |
| 5,070,662 | 12/1991 | Niese . | |
| 5,155,960 | 10/1992 | Shaanan . | |
| 5,157,890 | 10/1992 | Jines | 52/582.1 |
| 5,403,637 | 4/1995 | Pickard et al. | 52/177 X |
| 5,483,779 | 1/1996 | Crawford et al. | 52/656.1 X |
| 5,579,621 | 12/1996 | Fang | 52/656.1 X |
| 5,634,309 | 6/1997 | Polen | 52/177 X |
| 5,865,004 | 2/1999 | Mitchell | 52/582.1 |

PORTABLE FLOOR

BACKGROUND

1. Field of the Invention

The present invention is directed to a portable floor system, and in particular to a portable floor system having improved alignment with corner edge trim panels.

2. Prior Art

Portable floors generally have a number of interlocking rectangular sections or panels, and are used for providing a temporary hard surface that may be set up over carpeting or other surfaces on a temporary basis by joining the floor sections together in an edge-to-edge relationship. Locks or other connections are provided along the edges of the floor panels to secure the adjacent panels together to form an extended floor surface.

Portable floors are used for a variety of purposes and are particularly useful in the hospitality and entertainment industry. It is often desired to provide a temporary smooth, hard surface for dancing or other activities that can be removed so the space may be used for other activities. The floors are usually connected in an edge-to-edge fashion with releasable locks along their edges. A portable dance floor of this general type is disclosed in U.S. Pat. No. 4,988,131 to Wilson et al., assigned to Sico, the Assignee of the present invention. This patent discloses a portable floor having automatic locks that require alignment tabs along the edges of the panels. However, the edges are molded, leading to manufacturing challenges over generally less costly designs having extruded edges. Another portable floor of this general type is disclosed in U.S. Pat. No. 3,310,919 to Bue et al., also assigned to Sico, the Assignee of the present invention. In that patent, floor panels are provided, each having an extruded tongue section along certain edges and a complementary extruded groove section along certain other edges, such that the adjoining sections can be fitted together in an edge-to-edge relationship by tongue and groove arrangement, and held in place by threaded locking screws mounted above the grooves to engage notches in the tongue members. Although the portable floor disclosed in that patent has been successful in providing a convenient and efficient portable floor, the present invention provides an improved portable floor and construction that provides additional advantages.

Prior portable floors include edge trim panels that have a sloping upper surface to provide a transition between the underlying surface and the raised portable floor surface. The edge trim panels generally have the same interlocking relationship as other floor panels for attaching to the edges of the portable floor. For manufacturing purposes, it is often desirable to have extruded edge trim panels that are cut at intermittent lengths to form sections having the same length as the floor panels. The edge trim corner sections are generally configured with forty five (45) degree angled ends fitting with complementary sections to form a right angle at the corner of the floor. A problem with such edge trim panels is that if the underlying surface is uneven, it may be difficult to align the edge trim and especially, the corner edge trim panels. The edge trim panels may twist, warp or otherwise become misaligned, creating a less pleasing appearance.

Another problem with the extruded edges is the difficulty in maintaining alignment between the adjacent floor panels until fully secured together. The edge trim panels shown in U.S. Pat. No. 3,310,919 use a threaded screw-type member that does not tend to create relative movement. However, cam-type locks provide quicker and easier connections to the floor panels. With such locks, the floor panels and edge trim panels tend to slide relative to one another unless alignment is maintained. Although tabs and slots may be molded in the edges of the various panels as shown in U.S. Pat. No. 4,988,131, such alignment is much more difficult to maintain with extruded tongue and groove edges, as shown in U.S. Pat. No. 3,310,919.

It can be seen then that an improved floor is needed that can be easily and quickly joined while maintaining alignment of adjacent panels. In addition, such a floor should have improved edge trim that resists relative movement and misalignment between the ends of adjacent edge trim panels, especially those angled ends at the corners of the portable floor. The present invention addresses these as well as other problems associated with portable floors and the edge trim for portable floors.

SUMMARY OF THE INVENTION

The present invention relates to a portable floor system, and in particular, to a floor system having improved alignment and connection.

The portable floor of the present invention provides a temporary floor surface that is suitable for dancing or other activities while providing multi-use capability for the space in which the floor is placed. The present invention provides a portable floor having a plurality of substantially rectangular floor panels connecting and locking along their edges to form a continuous extended floor surface. Along the edges of the floor are edge trim panels that provide a transition from the portable floor surface to the underlying surface.

Each of the floor panels includes a planar core portion with an extruded edge section. The edges form complementary tongues and grooves for aligning the edges together and ensuring a proper fit with no gaps between the panels. The panels are locked together by a cam-type rotary lock having complementary male and female members on the contacting edges of adjacent panels. As the cam locks engage, the camming action tends to slide the panels relative to one another along the edges, requiring effort from assemblers to maintain the floor panels in alignment. The present invention provides for forming alignment notches in the tongues of the floor sections. The pins insert vertically through the top of the panel through the groove space and are aligned with the corresponding notches in the tongue of the next panel. The notches and pins prevent lateral sliding of the floor panels along their edges.

The edge trim panels have support ribs extending longitudinally along their length below a sloping upper surface. Two of the ribs form a slot therein that is configured for receiving alignment members. The corner edge trim panels include forty five (45) degree angled ends that are complementary to one another to form a right angled corner. The alignment members insert into the slots at the corner and prevent the corner edge trim panels from becoming misaligned. The alignment members may be straight for the other non-corner sections. The corner alignment members are generally L-shaped and may include two embodiments, a first embodiment wherein the legs are of equal length and have set screws for attaching to each corner edge trim panel, and a second embodiment with a longer leg having a set screw for attaching to one panel and a shorter leg inserting into the end of an adjacent panel. The alignment members may be more permanently connected so that the complementary edge trim panels may be attached to the corner panels as a unit with the longer L-shaped connector member. The L-shaped member having a shorter leg generally is attached to one member and the complementary member is retained rather than attached to the alignment member. The edge trim panels also include a rib configured for mounting the cam lock assembly and complementary notches and pins for engaging and aligning with the floor panels.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in that there is illustrated and described a preferred embodiment of the invention.

DETAILED DESCRIPTION OF THE PREFERRED EMBODIMENT

Figure 1:
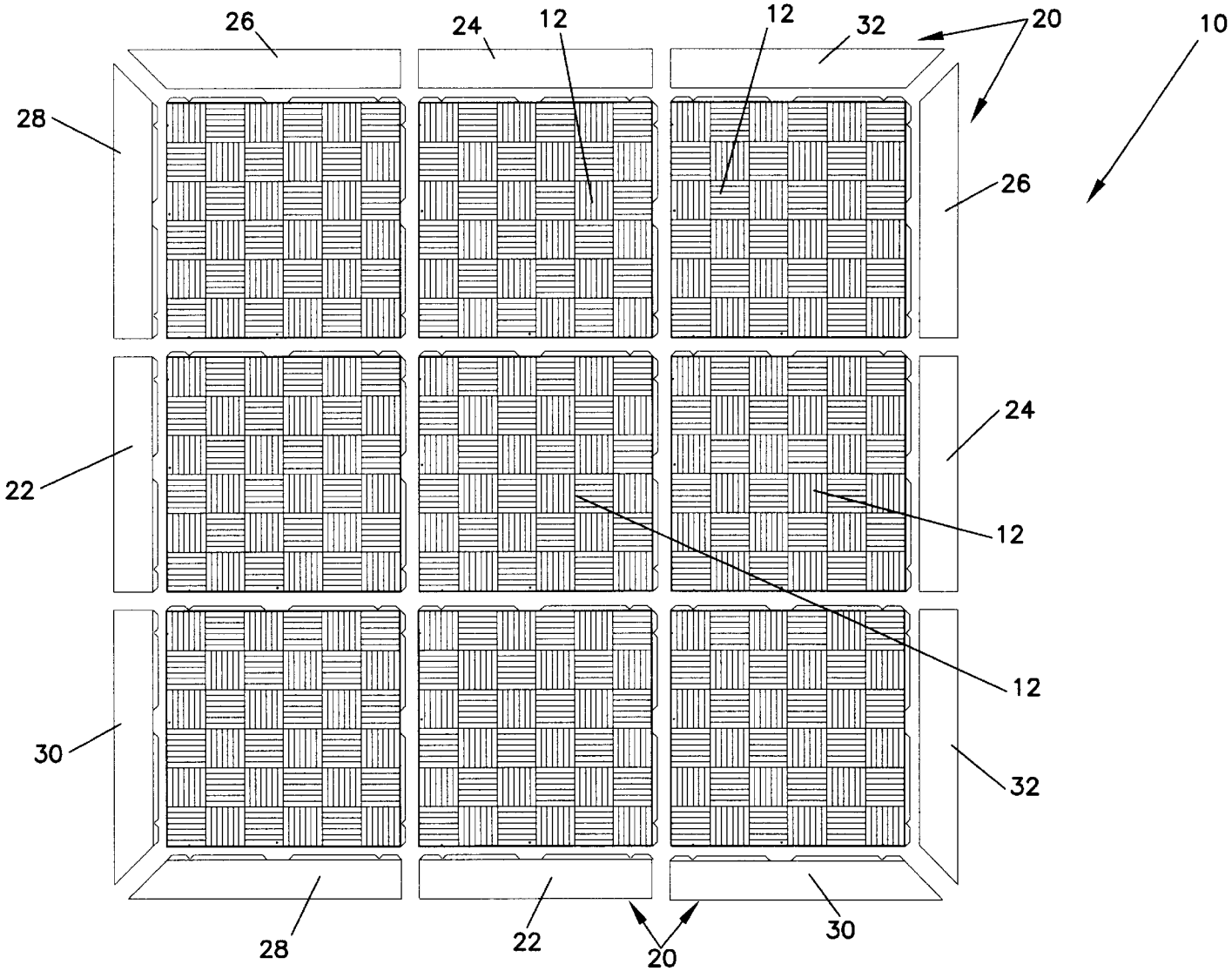
FIG. 1 shows a top plan view of a portable floor according to the principles of the present invention.
Figure 2:
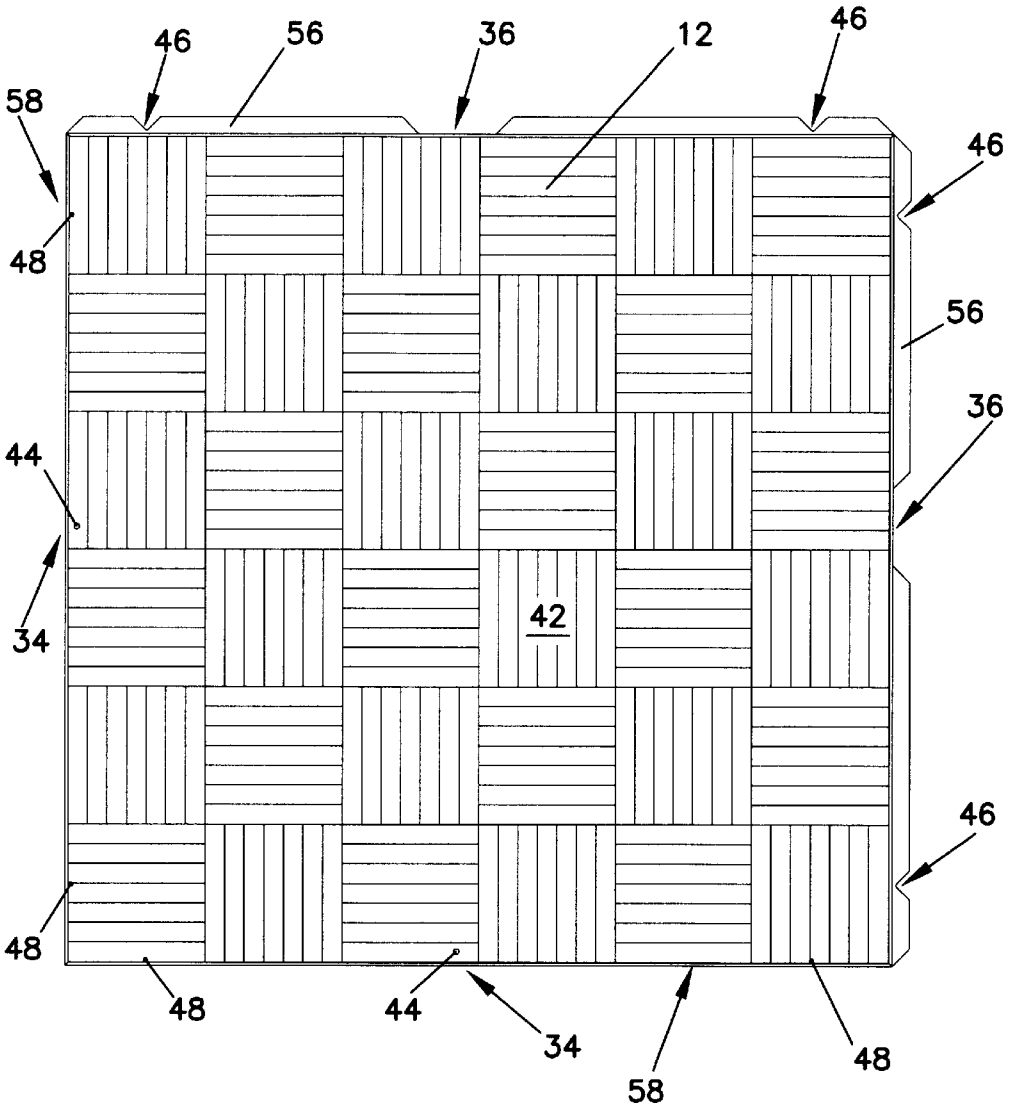
FIG. 2 shows a top plan view of a floor panel for the portable floor shown in FIG. 1.
Figure 3:
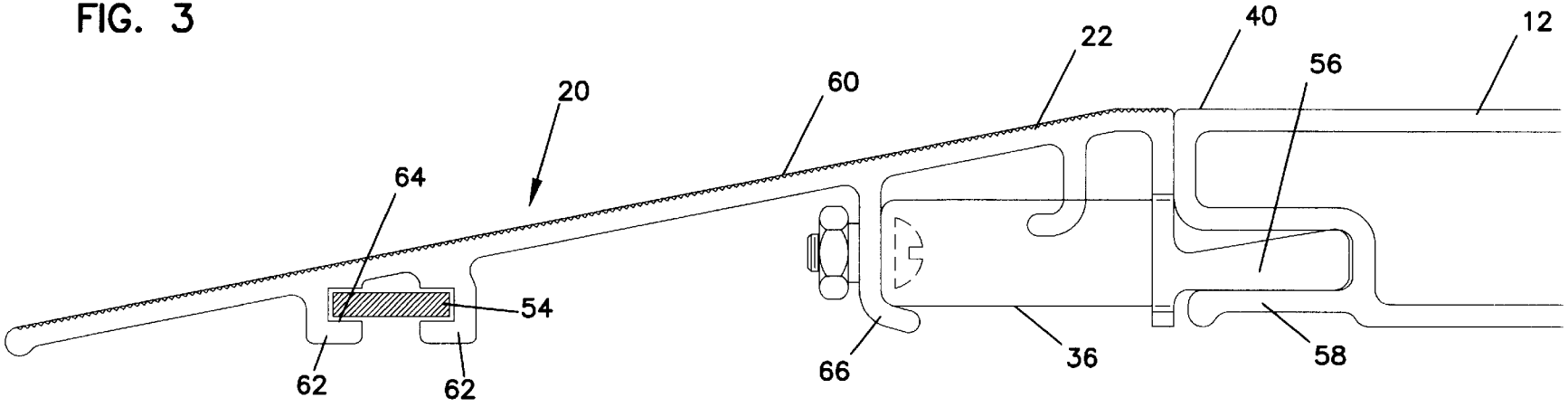
FIG. 3 shows an end elevational view of an edge trim panel for the portable floor shown in FIG. 1 and having a tongue connected to a floor panel.
Figure 4:
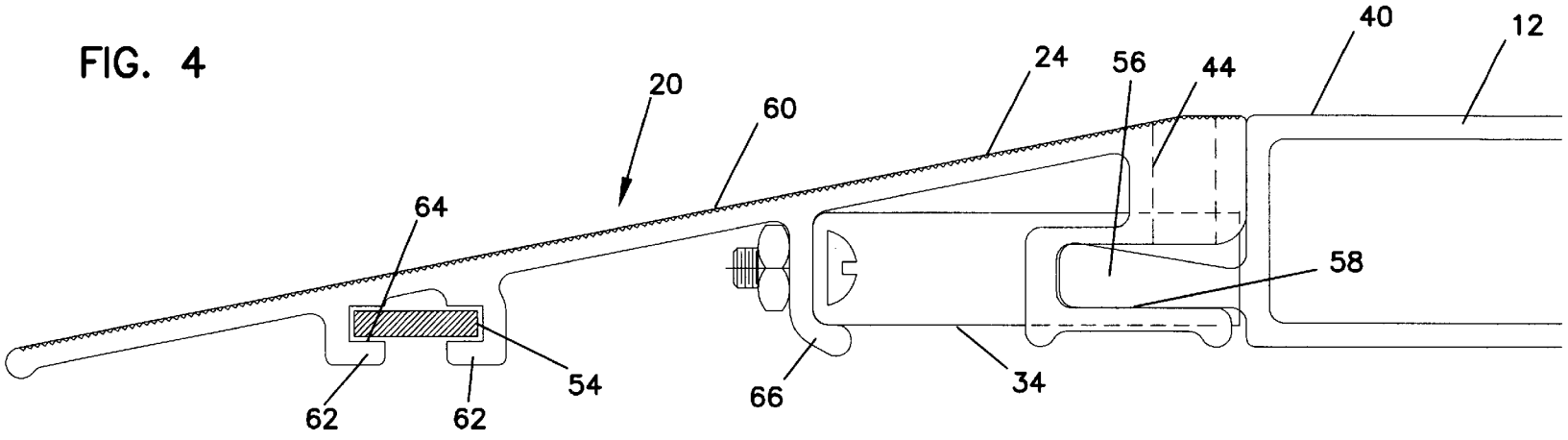
FIG. 4 shows an end elevational view of an edge trim panel for the floor shown in FIG. 3 having a groove attached to a floor panel.
Figure 5:
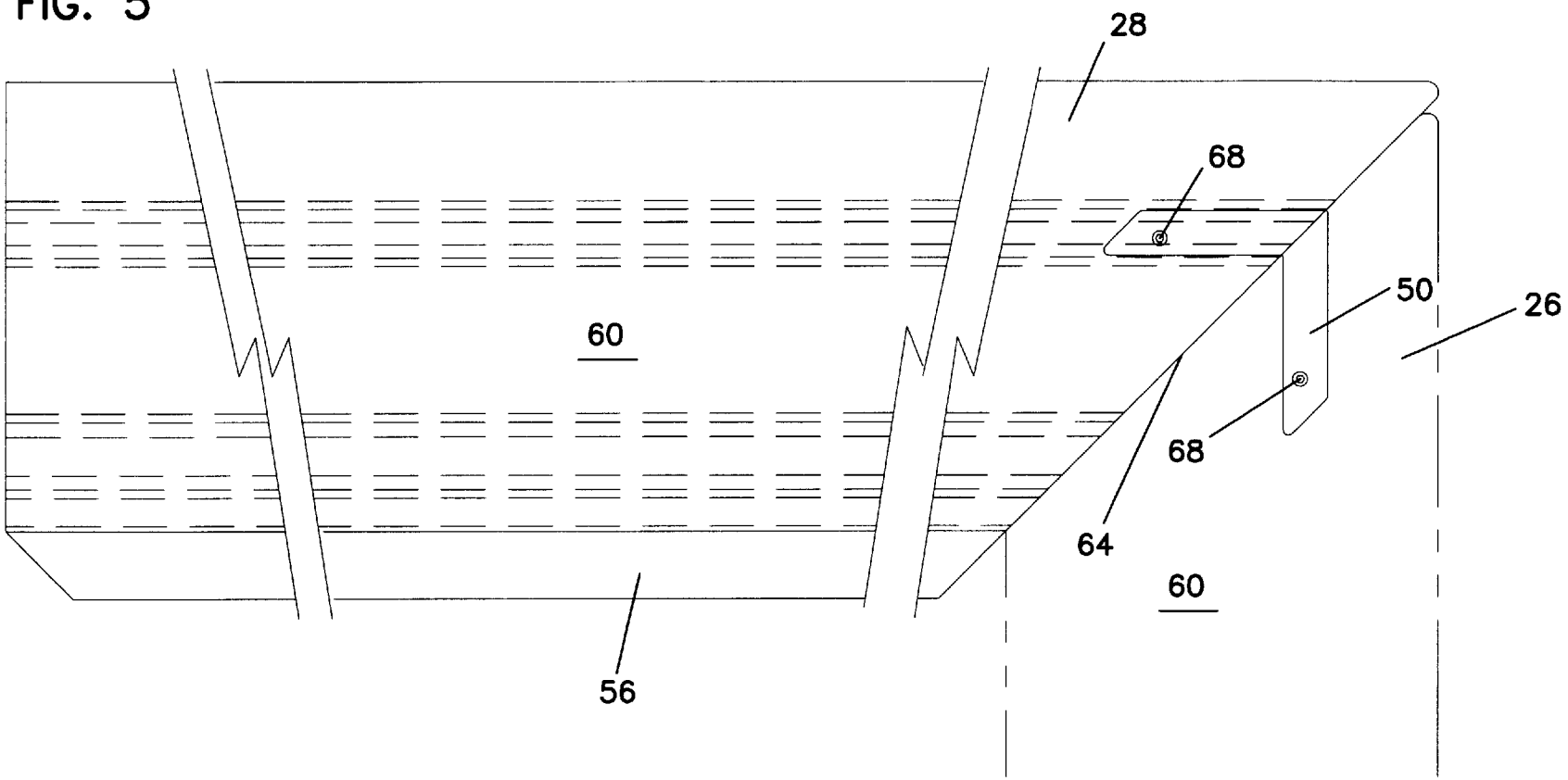
FIG. 5 shows a top plan view of complementary corner edge trim panels and a first embodiment of a corner alignment member.
Figure 6:
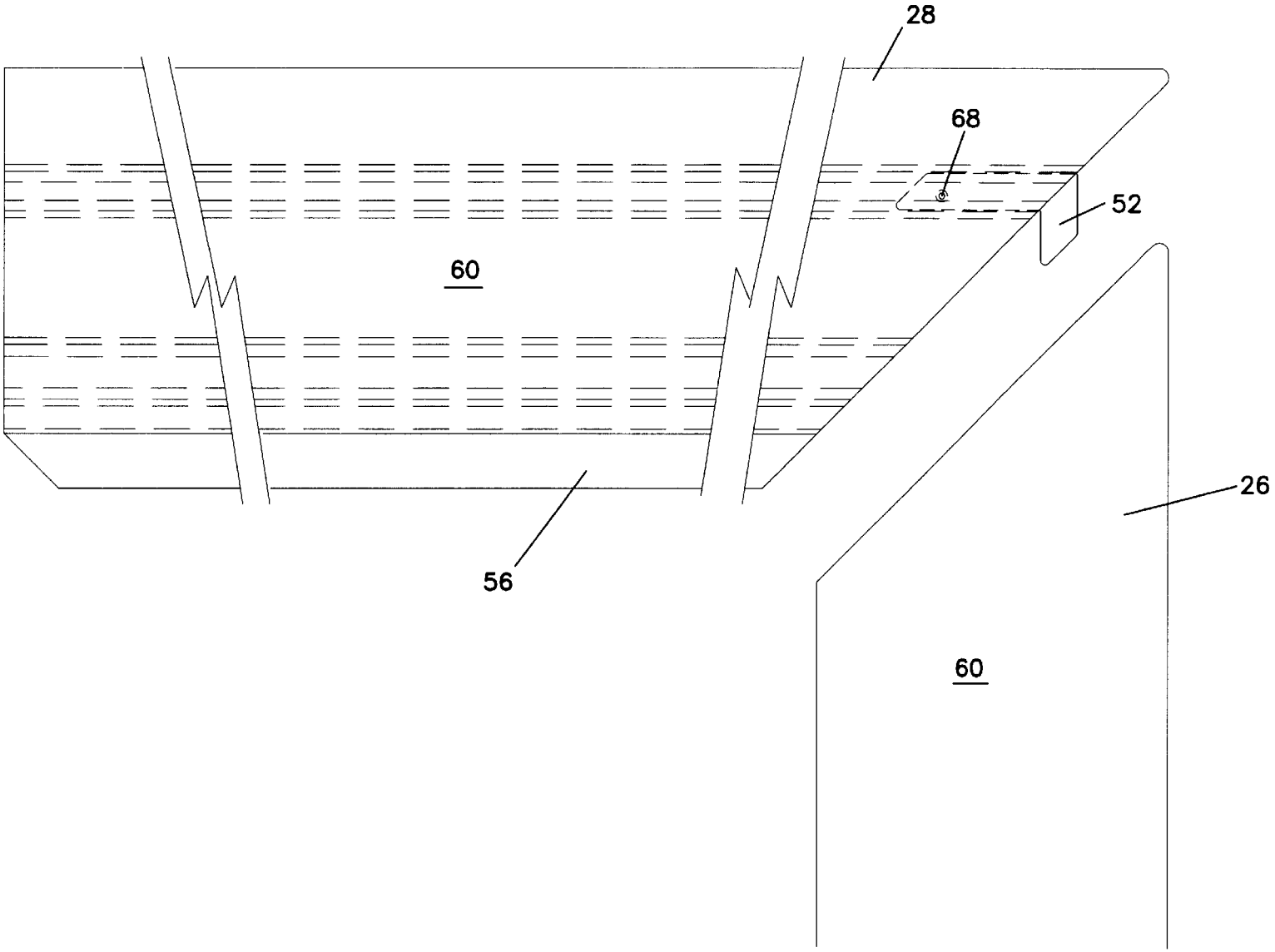
FIG. 6 shows a top plan view of complementary corner edge trim panels and a second embodiment of a corner alignment member.
Figure 7:
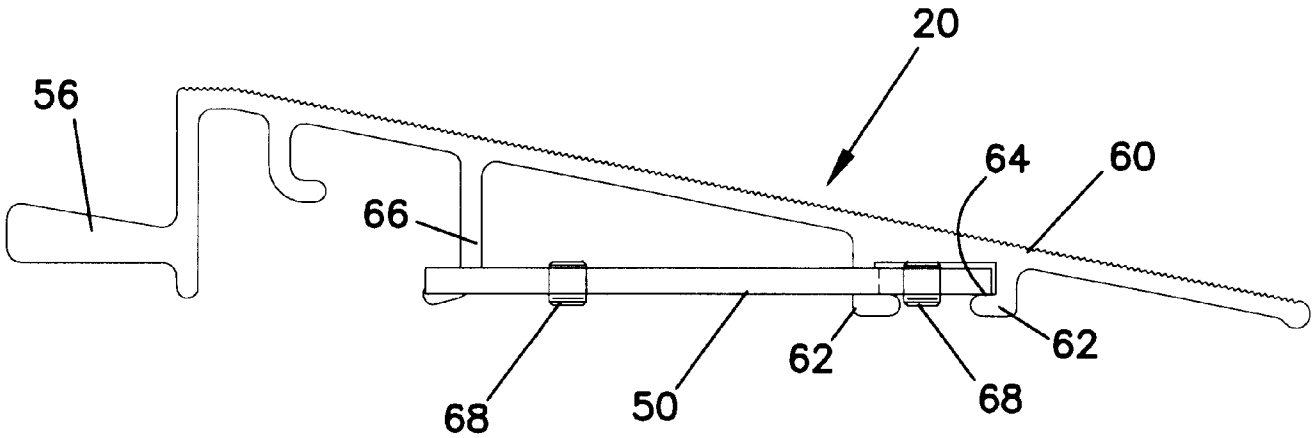
FIG. 7 shows a sectional view through the lock element for the edge trim panel shown in FIG. 3; and, FIG. 8 shows a sectional view through the lock element for the edge trim panel shown in FIG. 4.
Figure 8:
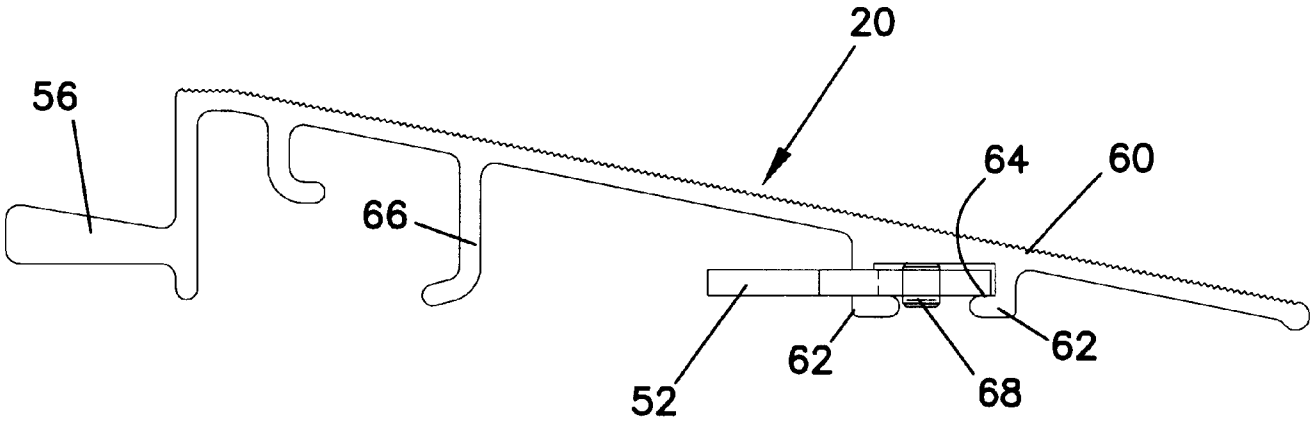

Referring now to the drawings, and in particular to FIG. 1, there is shown a portable floor system, generally designated 10. The floor system 10 includes a plurality of generally rectangular floor panels 12 joined in edge to edge relationship to form an extended upper floor surface 42 as shown in FIG. 2. Such panels generally include a lightweight center core with an extruded edge 40 as shown in FIGS. 3 and 4. The extruded edge 40 typically includes a tongue 56 along two edges and complementary grooves 58 formed along the other two edges. In this manner, the tongues 56 insert into the corresponding grooves 58 and provide alignment of the edges of adjacent panels 12. To lock the edges together, complementary rotating cam locks 34 and 36 are utilized in a first embodiment. However, other locks may also be used. Male rotating cam-lock devices 34 having a rotatable circular cam mount along the edges having grooves 58 while complementary female cam lock members 36 mount along the center of the edges having tongues 56 and receive and retain the cam member when the lock is actuated. The male cam members are actuated by rotating the cam with an Allen Wrench type tool inserting into an orifice 44 in the upper surface 42 of the floor panels 12. The complementary cam lock devices 34 and 36 pull the floor panels 12 together and ensure no gaps are formed in the floor and a tight edge to edge connection between adjacent panels 12. Edge trim panels 20 form a border and provide a transition from the upper surface 42 to the underlying surface of the edges of the floor 10 and connect to the floor panels with tongue and groove construction and complementary lock devices 34 and 36.

Since the camming of the lock devices 34 and 36 tends to slide adjacent panels laterally relative to one another, it is advantageous to have an alignment structure formed in the edges 40 to resist sliding. However, if the edges 40 are extruded, it is extremely difficult to form alignment members into the edges. As shown in FIG. 2, the tongues 56 have portions machined out to form notches 46. To align with and engage the notches 46, vertical pins 48 are inserted through the top of the floor panel 12 and into the grooves 58. The vertical pins 48 are aligned with the notches 46 to provide resistance to relative sliding between adjacent panels 12 along their edges. The addition of the alignment notches 46 and pins 48 helps to retain the panels 12 in aligned position relative to one another and to align the locks 34 and 36 for easy actuation to secure adjacent panels 12 to one another. The notches 46 and pins 48 can also be utilized in the edge trim panels 20 to provide alignment with the corresponding floor panel 12 and reduce the likelihood of relative sliding.

In a preferred embodiment, each of the edge trim panels 20 is an extruded member having either a horizontally extending tongue 56 or complementary groove 58 for attaching to the complementary edge on a floor panel 12. The edge trim panels 20 have a sloping upper surface 60 that provides a transition between the underlying surface and the portable floor surface. The surface 60 typically has ridges formed therein to provide a better grip. As shown in FIGS. 3–4 and 7–8, each of the edge trim panels 20 includes ribs 62 extending longitudinally below the upper surface 60 providing support and forming a slot 64 therebetween. Each of the edge trim panels 20 also includes a rib 66 that is positioned so as to provide a horizontal mounting surface for the housings of the cam lock members 34 or 36, as shown most clearly in FIGS. 3 and 4.

Along the straight portions of the floor 10, edge trim panels 24 having a groove 58 engage the edges of the floor 10 having a tongue 56, as shown in FIG. 4. Along the other two edges of the floor 10, edge trim panels 22 having a tongue 56 engage the complementary groove 58 of the floor panels, as shown in FIG. 3. At the corners of the floor 10, each corner edge trim panel 26, 28, 30 or 32 has a forty five (45) degree angled end that is complementary to the edge trim panel on the adjacent side of the floor 10. Two of the corners of the floor will have corner edge trim panels 26 having a left hand facing angled corner portion and a groove 58. The rectangular floor has two panels 28 having a right facing angled end portion and a tongue 56. At two corners of the floor 10, corner edge trim panels 30 having left hand facing angled portions and a tongue 56 are used. The floor also has two corner edge trim panels 32 having right hand facing angled end portions and a groove 58. Edge trim panels 24, 26 and 32 have an end profile as shown in FIG. 4, while edge trim panels 22, 28 and 30 have the end profile shown in FIG. 3.

Although the various corner edge trim panels 26, 28, 30 and 32 normally align without difficulty, the sharp corner portion may become slightly misaligned relative to the complementary portion, especially if the underlying surface is uneven. The present invention has "L" shaped connectors 50 and 52 for support and alignment at the corners, as shown in FIGS. 5–8. Straight connectors 54 may be utilized for providing alignment between adjacent edge trim panels having perpendicular ends, as shown in FIGS. 3 and 4. A first embodiment of a connector is the "L" shaped connector 50 having legs of equal length and an attachment screw 68 on each leg. A second connector embodiment 52 is an "L" shaped connector 52 having legs of unequal length and a set screw 68 on only the longer leg. Each of the connectors 50, 52 and 54 is configured for inserting into the end of the slot 64 formed in the edge trim panels 20. The connectors 50, 52 and 54 are held in place by tightening the set screws 68. The connector 50 provides a more permanent connection extending into and locking to each of the corner edge trim panels 26, 28, 30 and 32 to maintain alignment. The connector 52 has one shorter leg that may be inserted into the slot 64 of the complementary edge trim panel 20 without attaching to the panels, while the longer leg may be permanently mounted to the other edge trim panel 20. The shorter exposed leg of the connector 52, extending beyond the angled end of the corner edge trim panel 20 is not as likely to become bent or misaligned. With this configuration, should any of the connectors 50, 52 or 54 become twisted, bent or otherwise misaligned, they are easily removed and replaced at very little expense without damage to the edge trim panels 20.

The connectors 50 having extended length may be more permanently mounted so that complementary pairs of the corner edge trim panel 26 or 28 and 30 or 32 may be mounted in pairs to the corner of the floor 10 as an L-shaped unit. The cam locks 34 and 36 may be slid together slightly off center from a direct perpendicular approach for engagement and still actuate and secure the edges. The angled sides of the notches 46 and the pins 48 provide alignment and also allow for an approach between complementary edges at other than perpendicular.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in that the appended claims are expressed.

What is claimed is:

1. An edging system for portable floors, comprising:

a plurality of edge trim panels adapted for attaching around a periphery of a portable floor, including corner panels having complementary ends;

support ribs extending along the corner panels and forming a slot; and, first and second interchangeable L-shaped alignment members including a first alignment member with a first leg having a first length removably inserted into the end of the slot of a first corner edge trim panel and a second leg fixedly inserted into the end of the slot of an adjacent corner edge trim panel, and a second alignment member having a first leg with a second length greater than the first length fixedly inserted into the end of the slot of the first corner edge trim panel and a second leg fixedly inserted into the end of the slot of the adjacent corner edge trim panel.

2. An edging system according to claim 1, further comprising straight alignment members, inserted into the end of perpendicular ends of edge trim panels.

3. An edging system according to claim 1, wherein the second leg of the alignment members are fixedly inserted into the slot of the adjacent corner trim panel.

4. A portable floor system, comprising:

a plurality of floor panels connected along their edges to form a portable floor;

a plurality of edge trim panels attached around a periphery of the portable floor, including corner panels having complementary ends;

support ribs extending along the corner panels and forming a slot; and, a first L-shaped alignment member having a first leg fixedly inserted into the end of the slot of a first corner panel and a second leg removably inserted into the end of the slot of an adjacent corner panel.

5. A portable floor system according to claim 4, further comprising a second interchangeable L-shaped alignment member; wherein the first leg of the second alignment member is fixedly inserted into the slot of the first corner trim panel and the second leg of the second alignment member is fixedly inserted into the slot of the adjacent corner edge trim panel.

6. A corner locking system according to claim 4, wherein the corner panels have a sloping upper surface.

7. A corner locking system according to claim 6, wherein the slot is a horizontal, longitudinal slot.

8. A floor panel edge trim system, having a plurality of edge trim panels, including complementary edge trim panels, the edge trim system comprising:

first, second and third interchangeable corner devices, wherein:

the first corner device is adapted to mount to floor panels, the first corner device having complementary corner edge trim panels placed in non-meshing end to end alignment; and the second corner device is adapted to mount to floor panels, the second corner device having complementary corner edge trim panels having a slot formed therein and an L-shaped alignment member extending into the slot, the alignment member having legs fixedly inserted in the slot; and a third corner device is adapted to mount to floor panels, the third corner device having complementary corner edge trim panels having a slot formed therein with an L-shaped alignment member extending into the slots, the alignment member having legs with unequal lengths, including a first leg having a first length slidably inserted in the slot and a second leg having a second length greater than the first length fixedly inserted in the slot.

9. A floor system, comprising:

a first floor panel with an extruded edge section having a tongue portion, the tongue portion having a notch formed therein;

a second floor panel with an extruded edge section having a groove portion adapted for engaging the tongue portion;

a vertical pin extending through the groove portion and adapted for alignment with the notch;

a plurality of edge trim panels adapted to be attached around a periphery of the floor system, including corner panels having complementary ends;

support ribs extending along the corner panels and forming a slot; and, first and second interchangeable L-shaped alignment members, including a first alignment member with a first leg adapted to be removably inserted into the end of the slot of a first corner edge trim panel and a second leg adapted to be fixedly inserted into the end of the slot of an adjacent corner edge trim panel, and a second alignment member having a first leg adapted to be fixedly inserted into the end of the slot of the first corner edge trim panel and a second leg adapted to be fixedly inserted into the end of the slot of the adjacent corner edge trim panel.

10. A floor system according to claim 9, wherein each of the floor panels comprises a rectangular panel with two edges having tongues and two edges having grooves.

11. A floor panel edge trim system, having a plurality of edge trim panels, including complementary edge trim panels, the edge trim system comprising:

first and second corner devices, wherein:

the first corner device is adapted to mount to floor panels, the first corner device having complementary corner edge trim panels with a slot formed therein and an L-shaped alignment member extending into the slots, the alignment member having legs fixedly inserted in the slots;

the second corner device is adapted to mount to floor panels, the second corner device having a slot formed therein with an L-shaped alignment member extending into the slots, the alignment member having legs with unequal lengths, including a first leg having a first length removably inserted in the slot and a second leg having a second length greater than the first length fixedly inserted in the slot.

12. An edging system for portable floors, comprising:

a plurality of edge trim panels adapted to be attached around a periphery of a portable floor, including corner panels having complementary ends;

support ribs extending along the corner panels and forming a slot; and, first and second interchangeable L-shaped alignment members, including a first alignment member with a first leg removably inserted into the end of the slot of a first corner edge trim panel and a second leg fixedly inserted into the end of the slot of an adjacent corner edge trim panel, and a second alignment member having a first leg fixedly inserted into the end of the slot of the first corner edge trim panel and a second leg fixedly inserted into the end of the slot of the adjacent corner edge trim panel.

* * * * *